US005636998A

United States Patent [19]

Daly et al.

[11] Patent Number: 5,636,998

[45] Date of Patent: *Jun. 10, 1997

[54] PLUGGABLE MALE TERMINATOR

[75] Inventors: John J. Daly, Chicago; Daniel S. Poplawski, Montgomery, both of Ill.

[73] Assignee: Methode Electronics, Inc., Chicago, Ill.

[*] Notice: The portion of the term of this patent subsequent to Feb. 28, 2012, has been disclaimed.

[21] Appl. No.: 514,655

[22] Filed: Aug. 14, 1995

Related U.S. Application Data

[63] Continuation of Ser. No. 843,401, Feb. 28, 1992, Pat. No. 5,472,348.

[51] Int. Cl.[6] ..... H01R 9/09

[52] U.S. Cl. ..... 439/76.1; 439/498

[58] Field of Search ..... 439/139, 135, 439/149, 148, 76.1, 620

[56] References Cited

U.S. PATENT DOCUMENTS 3,551,874 12/1970 Volinskie ..... 439/76.1 X
3,573,704 4/1971 Tarver ..... 439/76.1 OR
4,857,002 8/1989 Jensen .
4,881,902 11/1989 Papa et al. ..... 439/76.1 OR
5,472,348 12/1995 Daly et al. ..... 439/76.1 OR

*Primary Examiner*—David L. Pirlot
*Assistant Examiner*—Daniel Wittels
*Attorney, Agent, or Firm*—Hill, Steadman & Simpson

[57] ABSTRACT

A pluggable male terminator for use with a female ribbon cable connector. The terminator is comprised of three basic parts that can snap together. The three members are a shroud having openings in the top, a PC board with pins extending from opposed surfaces, and a cover with recesses therein. The pins are complementary in shape and size to the openings in the shroud and the recesses in the cover. Further, the pins are aligned with the openings in the shroud and the recesses. For assembly, the pins on the PC board are inserted into the recesses in the cover openings in the shroud and the parts are pushed together. The pins extending from the shroud are adapted to be inserted into recesses in the female ribbon cable connector.

9 Claims, 2 Drawing Sheets

PLUGGABLE MALE TERMINATOR

This is a continuation, of application Ser. No. 07/843,401, filed Feb. 28, 1992, now U.S. Pat. No. 5,472,348.

BACKGROUND OF THE INVENTION

This invention pertains to a pluggable male terminator for use with a female ribbon cable connector.

In the past a termination network plugged onto relatively low cost male contacts that were soldered directly onto a printed circuit board. If the user wanted to travel some distance with the signals, he had to use a cable that had a similar number of conductors as found in the transmission lines. The conductor count can range from as few as 40 wires to as many as 96 wires.

Because of the time involved in soldering and aligning large numbers of wires to a single connector, various mass wire termination techniques have been employed. One of these techniques is called insulation displacement contact or IDC. With this IDC technique, a large number of wires are formed into a flat group with regular spacing from conductor to conductor. This ribbon of wires can have a connector installed onto it in one step, with the result that a single contact will be made from each wire in the ribbon. Ideally, the connection of the wire to a contact is made by a knife-like area in the contact that slices through the insulation on the wire and touches the conductor inside, thus making the circuit.

In order to stamp the knife-like edge into the contact it is necessary to start with a suitably thin material (typically 0.012 inches thick). While this material thickness makes a good knife, it does not make good connector. The other end of the knife must make a good connection so that the signal will be properly transferred. Male contacts are typically 0.025 inch or more thick for bend resistance. Female contacts can be much thinner because they form around the inserted male contact. Low cost IDC connectors are typically female. Additionally, because of the material thickness, the male contacts that are available are only suitable for soldering directly into the holes in printed circuit board. IDC connectors that are constructed into male contacts must undergo elaborate forming techniques to bring the thickness to a usable level. The attached female contact is almost three times more costly than the attached male connector. Thus, a presently preferred termination network has female contacts that are plugged by male tails.

If the user wants to install this termination network onto a cable, two options are available. First, use an expensive male IDC connector to plug the standard termination network. Second, connect the terminator directly to the cable using an IDC technique. To use the IDC technique, considerable mount of pressure is required to knife through the insulation on the wires. Connectors constructed of plastic and metal can withstand the typical IDC seating pressures of 500 pounds or more. However, terminators that are constructed of plastic, metal, a dozen or more resistors, capacitors and a printed circuit board cannot withstand this pressure and can be easily damaged if directly connected to a ribbon cable.

An object of this invention is to provide a pluggable male terminator that can be easily connected to a low cost female connector that is joined to a ribbon cable by an IDC connection.

Another object of this invention is to provide pluggable male terminator that comprises low cost DIN style contacts for use with female ribbon female connector.

Yet another object of this invention is to provide pluggable male connector comprised of shroud, PC board with pins extending from opposed surfaces and cover, the shroud, cover, and pins on the PC board having readily snapped together for assembly.

Other objects and advantages of the present invention will be made more apparent hereinafter.

BRIEF DESCRIPTION OF THE DRAWING

There is shown in the attached drawing a presently preferred embodiment of the present invention, wherein like numerals in the various views refer to like elements, and wherein.

DETAILED DESCRIPTION OF THE PRESENT INVENTION

Figure 1:
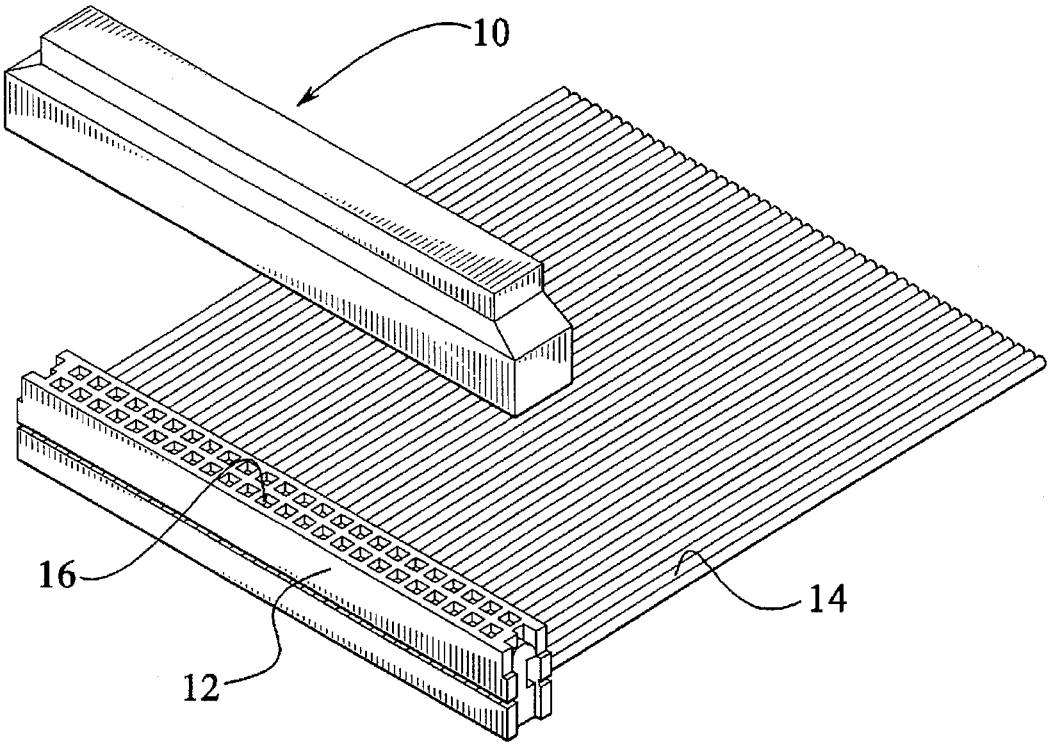
FIG. 1 is a perspective view of a ribbon cable with a female connector and illustrating the pluggable male terminator of the present invention positioned prior to connection to the female connector.
Figure 2:
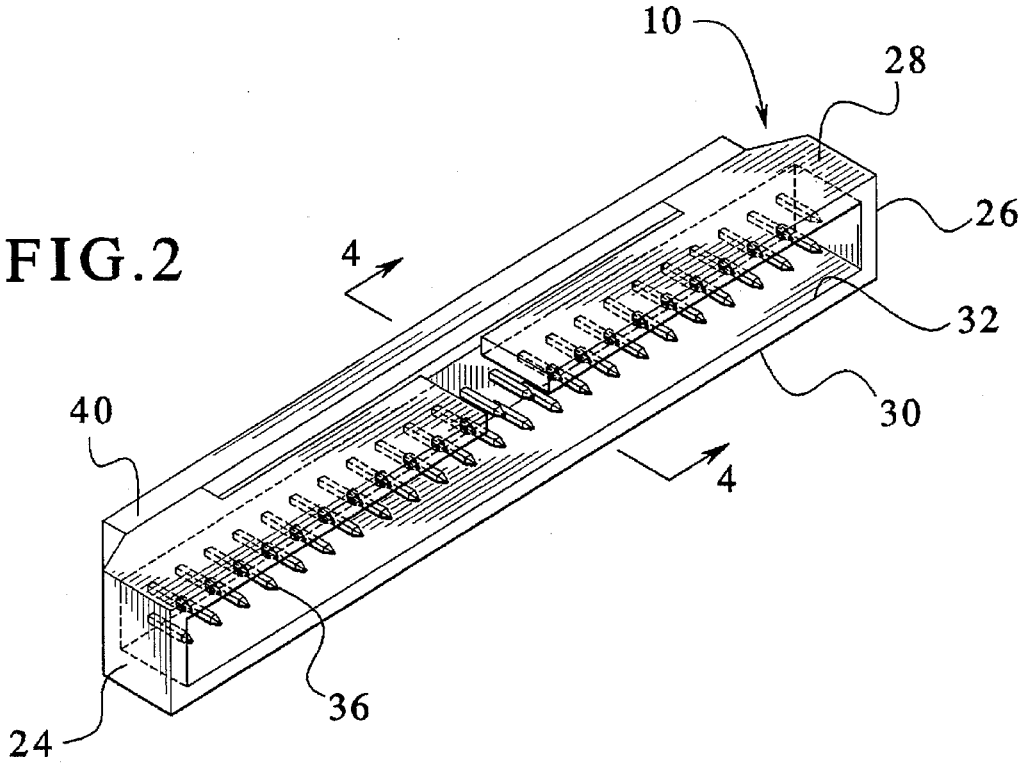
FIG. 2 is a perspective view of the pluggable male terminator taken from below.
Figure 3:
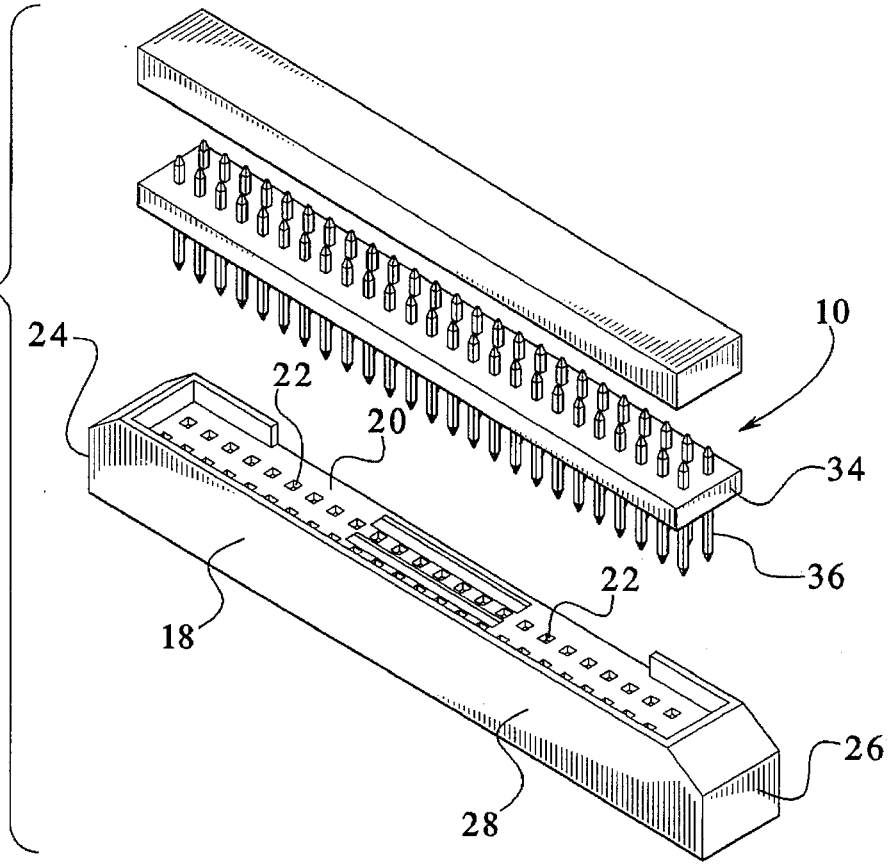
FIG. 3 is an exploded perspective view of the pluggable male terminator, illustrating the snap together construction.

With reference to FIG. 1, the pluggable male terminator 10 is adapted to be used with a female connector 12 that is affixed to a ribbon cable 14 by a known IDC technique. The female connector 12 has a plurality of recesses 16 for receiving the pins extending from the male terminator 10, as will be more fully explained hereinafter.

Turning to FIGS. 2–6, there is better shown the construction of the male terminator 10. The male terminator 10 comprises a body or shroud 18 having a top 20 with a plurality of openings 22 therein and side walls 24. 26, 28 and 30 defining an open bottom 32. Preferably the body 18 is molded from plastic.

The male terminator 10 includes a printed circuit (PC) board 34 containing thereon a plurality of circuit elements, e.g., resistors and capacitors, formed in a conventional fashion that need not be further discussed herein. A plurality of pins 36 extend outwardly beyond opposed surfaces of the PC board 34. Preferably, the number of pins 36 correspond to the number of openings 22 in the shroud 18. Further, the pins 36 are preferably of the same shape as the openings 22 and fit closely or snugly within the openings 22. The contacts or pins 36 may be fabricated from metal, for example, a copper alloy plated with gold over nickel.

Figure 4:
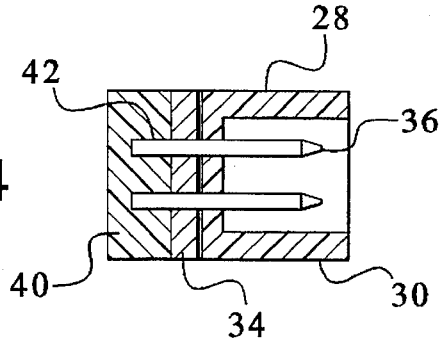
FIG. 4 is a cross section view of the pluggable male terminator, taken generally along the line 4—4 of FIG. 2.

The male terminator 10 includes a cover 40, which has a plurality of recesses 42 in the bottom thereof, as best seen in FIG. 4. The cover 10 may be molded from plastic. The recesses 42 correspond in number to the number of pins 36. Further, the recesses 42 are complementary in shape to the cross-section of the pins 36. In one presently preferred form of the invention, the pins 36, openings 22 and recesses 42 are square in cross-section. The recesses 42 are of sufficient depth to receive the portions of the pins 36 extending from the top of the PC board while seating firmly on the top of the PC board 34 when the parts of the male terminator 10 are assembled. Further, the openings 22 in the shroud 18 and the recesses 42 in the cover 40 are aligned with one another and with the pins 36, along the axis of the pins. As will be made more apparent hereinafter, the pins 36 may be inserted into recesses and openings aligned axially with the pins.

Figure 5:
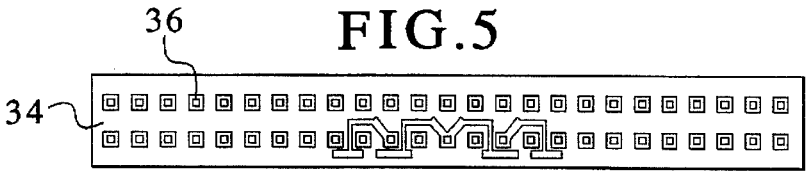
FIG. 5 is a plan view of the PC board of the pluggable male terminator.
Figure 6:
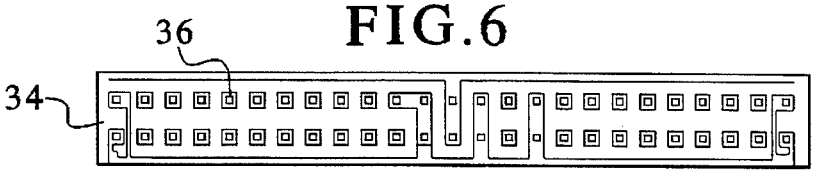
FIG. 6 is a bottom view of the PC board of the pluggable male terminator.

As shown in FIGS. 5 and 6, the PC board 34 has conventional components affixed thereto in a conventional fashion.

The shroud 18 is preferably molded from a suitable plastic. To assemble the male terminator 10, the PC board 34 is positioned over the top 20 of shroud 18 and pins 36 are inserted into the openings 22. Then the cover 40 is positioned over the PC board 34, with the tops of pins 36 aligned with the recesses 42 in the cover 40. The cover 40 is pressed toward the shroud is to seat the pins 36 in the openings 22 in the shroud and in the recesses 42 in the cover 40. The bottom of the PC board 34 is positioned against the top 20 of the shroud 18 and the cover 40 is positioned against the top of the PC board 34. The parts are snapped together and firmly secured to one another to form an assembled pluggable male terminator 10. There is no bending or damage to the PC board 34 by the assembly technique of the present invention.

The pluggable male terminator has mechanical polarization for proper orientation and may have standard single ended or differential small computer system interface (SCSI) terminations. SCSI is a local 1/0 bus that can be operated over a wide range of data rates depending upon the implementation choices. The prime objective of the interface is to provide host computers with devices independence within a class of devices. Thus, different disk drives, tape drives, printers, optical media drives and other devices can be added to the host computers without requiring modifications to generic system hardware or software.

The pluggable male terminator of the present invention is easily connected to a low cost female ribbon cable connector. The three parts of the pluggable male terminator are readily and reliably snapped together for assembly.

While we have shown a presently preferred form of the present invention, it will be apparent that it may be otherwise embodied within the scope of the appended claims.

We claim:

1. A male terminator for use with a female ribbon cable connector, the male terminator comprising:

a printed circuit board having a plurality of pins extending substantially perpendicularly from the major surfaces thereof;

a shroud secured to the printed circuit board; and a cover having a plurality of recesses for receiving first portions of the pins on one side of the printed circuit board and securing the cover thereto, second portions of the pins on the other side of the printed circuit board being adapted to engage said female ribbon cable connector.

2. The male terminator of claim 1 wherein the shroud comprises a planar member with a plurality of openings therein wherein the openings are complementary to the cross-section of the second portions of the pins, the pins being received therein to secure the printed circuit board to the shroud.

3. The male terminator of claim 2 wherein the second portions of the pins are substantially the same external configuration as the internal configuration of the openings in the shroud and are received snugly therein.

4. The male terminator of claim 3 wherein the second portions of the pins and the openings are of substantially square cross-section.

5. The male terminator of claim 2 wherein the first portions of the pins are of a non-circular cross-section and the openings in the shroud are of a circular cross-section.

6. The male terminator of claim 5 wherein the second portions of the said pins are of a square cross-section.

7. The male terminator of claim 1 wherein the first portions of the pins are complementary in cross-section to the cross-sections of the recesses in the cover.

8. The male terminator of claim 7 wherein the first portions of the pins are of a square cross-section, and the recesses are of a circular cross-section.

9. The male terminator of claim 7 wherein the first portions of the pins and the recesses are of substantially the same cross-section providing a snug fit between the exterior surfaces of the second portions of the pins and the interior surfaces of the recesses.

* * * * *